United States Patent [19]

Rice

[11] Patent Number: 4,539,780

[45] Date of Patent: Sep. 10, 1985

[54] STORM CELLAR OR THE LIKE

[75] Inventor: William C. Rice, Arlington, Tex.

[73] Assignee: Dalworth Construction Inc., Arlington, Tex.

[21] Appl. No.: 555,967

[22] Filed: Nov. 29, 1983

[51] Int. Cl.[3] ..... E04H 7/00

[52] U.S. Cl. ..... 52/169.6; 52/184; 52/186; 52/189

[58] Field of Search ..... 52/169.6, 184, 186, 52/182, 79.1, 79.4, 20, 21, 190, 185, 189

[56] References Cited

U.S. PATENT DOCUMENTS

| | | | |
|---|---|---|---|
| 2,936,504 | 5/1960 | Harris | 52/169.6 X |
| 3,173,387 | 3/1965 | Cree, Jr. | 52/169.6 X |
| 3,251,159 | 5/1966 | Trice | 52/169.6 X |
| 3,263,378 | 8/1966 | Dorris | 52/169.6 X |
| 4,226,062 | 10/1980 | Doane | 52/169.6 |

FOREIGN PATENT DOCUMENTS

| | | | |
|---|---|---|---|
| 1314461 | 12/1962 | France | 52/169.6 |
| 2092633 | 8/1982 | United Kingdom | 52/169.6 |

*Primary Examiner*—Carl D. Friedman

*Attorney, Agent, or Firm*—Scrivener Clarke Scrivener and Johnson

[57] ABSTRACT

A storm cellar or the like is disclosed composed of a pair of portable upper and lower pre-cast concrete sections one of which seats in an inverted position on the other to define a closed compartment. Each section includes a portion of a stairway of conventional configuration, the portions matching when the sections are assembled to extend from the lower level of the top of the assembled cellar to near its floor through aligned openings in the walls of the sections, thus permitting the cellar to be fully buried in the ground while at the same time providing ready access to the cellar from ground level without requiring that any portion of the cellar itself protrude above ground level.

10 Claims, 3 Drawing Figures

STORM CELLAR OR THE LIKE

This invention relates to storm cellars or the like and more particularly to prefabricated storm cellars adapted for location in a positon of use below ground level.

Though it will be apparent that the present invention has other uses, as for example, as a bomb shelter, it will, for convenience, be described herein in connection with its use as a storm cellar.

Though storm cellars pre-cast in sections for transport to a place of use are known, such cellars have heretofore usually extended partially above ground level in order to permit access to the cellar through a sloping hatchway. Though it is customary to pile material such as dirt around the upper exposed half of the cellar, and, in fact, such cellars can be disguised by tasteful terracing and planting, never the less such cellars require that there be a protruding mass above ground level in what might otherwise be a planar setting and this can be objectionable to some users. Further, although a cellar which is partially above ground level may provide adequate protection against tornados, the above ground portion of such a cellar migh not be able to withstand a bomb blast. Thus there has been a need for a portable pre-cast, sectional storm cellar which can be almost completely buried yet provide ready access to its interior without requiring the use of ladders or the like. A ladder is a slow means at best for use by a number of people who must seek immediate entrance to a cellar because of the unexpected appearance of a tornado, and ladders cannot be used at all by some handicapped or elderly people.

The broad object of the present invention therefore is to provide a storm cellar or the like of concrete, precast in sections, which is portable from the point of manufacture of sale to the point of use and which is particularly adapted for location substantially completely underground, while providing convenient and ready access between ground level and the interior of the cellar.

Other objects and their attendant advantages will become apparent as the following detailed description is read in conjunction with the accompanying drawings wherein.

Figure 1:
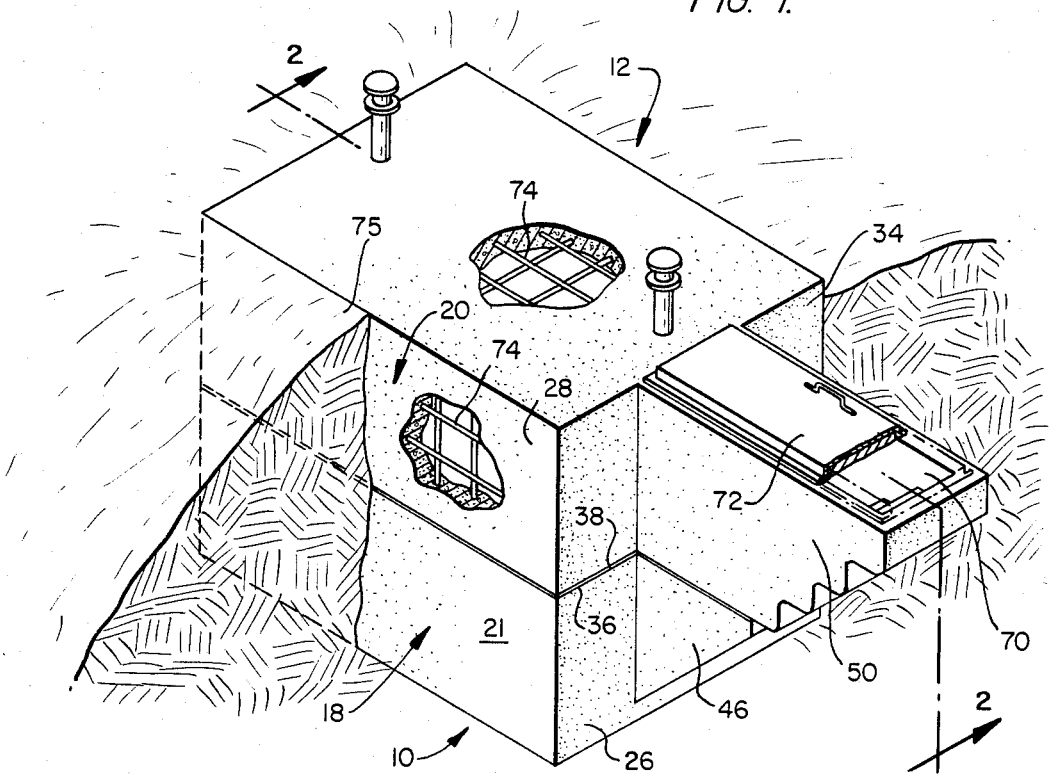
FIG. 1 is a perspective view of the storm cellar or the like constructed in accordance with the present invention and showing portions of the cellar broken away.
Figure 2:
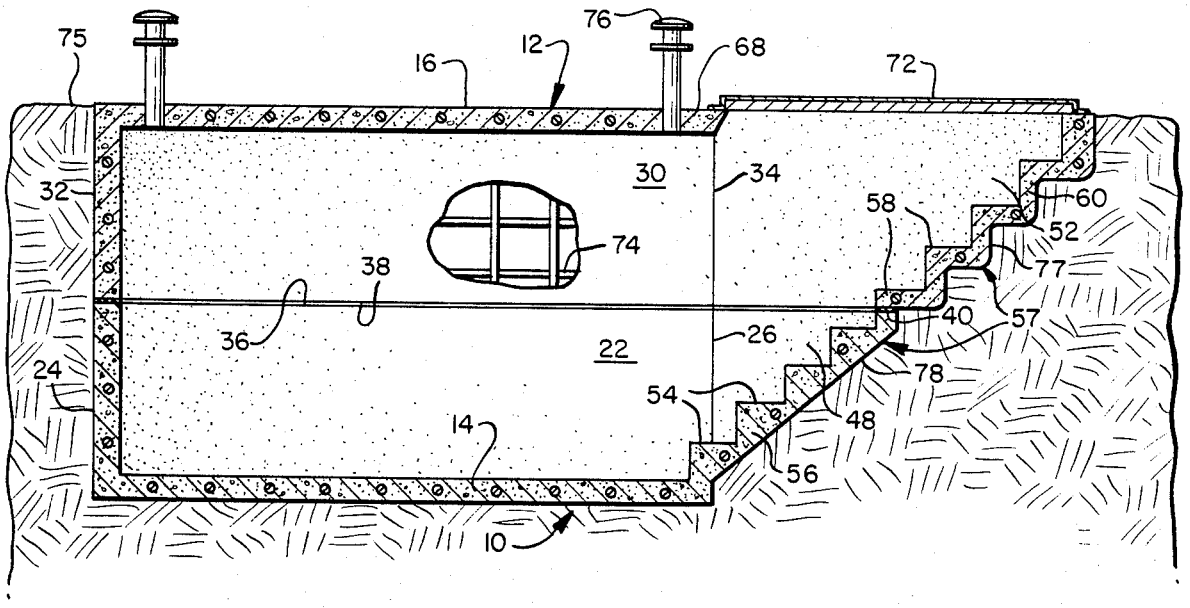
FIG. 2 is a vertical cross-sectional view of the cellar of FIG. 1 taken substantially on the line 2—2 of FIG. 1.

The cellar of the invention comprises a pair of separately pre-cast lower and upper concrete sections 10, 12. Each section has a respective horizontal wall 14, 16 defining the floor and ceiling respectively of the assembled cellar. Each section has a respective upstanding wall 18, 20 which extends around the perimeter of the respective horizontal walls and though the cellar might have other shapes it is preferably rectangular in horizontal cross-section with the lower section 10 having side walls 21, 22 and end walls, 24, 26. In like manner the upper section 12 has side walls 28, 30 and end walls 32, 34. The upstanding walls 18, 20 of each section have outer free edges 36, 38 terminating in horizontal planes spaced from the respective horizontal walls 14, 16 the free edges having like perimeters so that when the upper section 12 is inverted its free edge 38 can be seated on the free edge 36 of the lower section with the edges mutually engaging throughout their perimeters. Desireably, an elastomeric sealing gasket 40, as shown in FIG. 3, is interposed between the engaged free edges of the respective lower and upper sections 10, 12.

Figure 3:
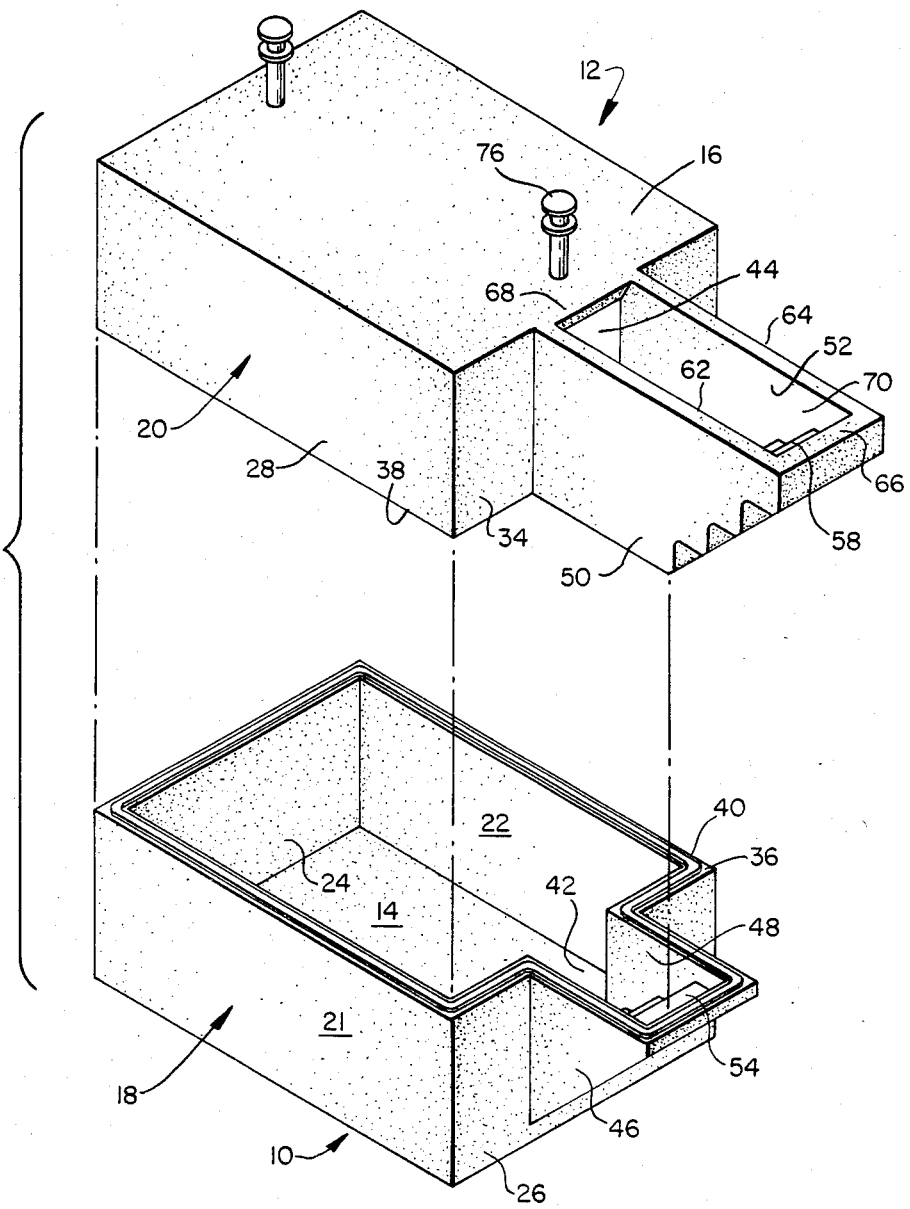
FIG. 3 is an exploded perspective view of the cellar of the present invention.

As best seen in FIG. 3, each of the upstanding walls 18, 20, of the cellar sections 10, 12 has a respective opening 42, 44 extending through the respective free edges 36, 38 of the sections and which, when the sections are joined, align with each other to define an entrance into the storm cellar. The opening 40 in the lower section 10 of the cellar is bracketed by a pair of laterally spaced or parallel upstanding walls 46, 48 whose upper free edges lie in the same plane as the edge 36 of the upstanding wall 18. In like manner the opening 44 of the upper section 12 is bracketed by a pair of laterally spaced walls 50, 52 having lower free edges lying in the same horizontal plane as the free edge 38 of the wall 20, the spacing between the free edges of the two walls of each pair being the same so that when the upper section 12 of the cellar is seated on the lower section the free edges of the pairs of walls also engage and the gasket 40 also extends between the latter engaged surfaces as seen in FIG. 3.

Between the lower pair of walls 50, 52 are steps 54 of an inner lower portion 56 of a stairway 57 , the portion 56 being cast integrally with the previously described portions of the lower section 10 of the cellar. Between the upper pairs of walls are steps 58 of an upper outer portion 60 of the stairway 57, the extent of both pairs of lateral walls 46, 48 and 50, 52 being sufficient to enclose the matching stairway portions 56, 60 when the two sections of the cellar are joined together. The steps 54, 58 of the stairway portions preferably have conventional width and height.

The respective upper edges 62, 64 of the upper pairs of walls 50, 52 define with the upper end 66 of the upper stairway portion 60 between the walls 50, 52, and a portion 68 of the horizontal wall 16 over the opening 44 of the upper section 12 a hatchway 70 whose upper edges preferably lie in the same horizontal plane as the upper surface of the upper horizontal wall 16. Cooperating with th hatchway 70 is a displaceable hatch 72 for closing the hatchway, it being understood that the hatch and hatchway can be provided with suitable means (not shown) for excluding water in a manner similar to the known means for excluding water from basement steps. Also, known means operable from the inside (not shown) for latching or locking the hatch in its closed position would be provided.

In use, the sections of the described storm cellar are pre-cast in molds around cages of reinforcing rods 74 in a conventional manner. The sections in their entirety can then be transported to their place of intended use and an excavation provided of a size and depth to accommodate the assembled cellar with its upper surface preferably at least flush with the surface 75 of the surrounding terrain. The lower section of the cellar would then be positioned in the excavation, the gasket material laid on or adhered to the upper free edge 36 of the section around its entire perimeter including the walls 46, 48 and the upper section would then be lowered onto the lower section until the free edges of the sections are engaged either with each other or with the gasket, depending upon the degree of compressibility of the latter. The excavation would then be back-filled around the cellar and the hatch 72, if not already in place, would be installed. The upper section if not already supplied with one or more of the ventilators 74 shown, would have these placed in position in previously formed openings through the horizontal wall 16 of the upper section.

Though the cellar is shown as rectangular in horizontal cross-section, it could as readily be circular, oval or any other convenient shape and the upstanding walls instead of being vertical, as shown, could slope outwardly with respect to the horizontal walls without departing from the scope of the invention. It will be noted that the outer surface 77 of the portion 10 of the stairway opposite the steps 58 conforms generally to the configuration of the steps, whereas the outer surface 78 of the lower portion opposite the steps 54 is flat. This is for convenience only and is of no significance so far as the overall invention is concerned, which is directed to a pre-cast storm cellar or the like which is capable of being positioned fully within the ground while providing ready convenient, and easily negotiated access from ground surface to the interior of the cellar. The invention is susceptible of a variety of modifications and changes without, however, departing from the scope and spirit of the appended claims.

What is claimed is:

1. A storm cellar or the like comprising a pair of separately pre-cast concrete upper and lower sections each section having a horizontal wall and an upstanding wall around the perimeter of the horizontal wall and having an outer free edge terminating in a horizontal plane spaced from the horizontal wall, the upper section being inverted in relation to the lower section, the free edges of each of said upstanding walls having like perimeters with the free edge of the inverted upstanding wall of the upper section being seated on the free edge of the upstanding wall of the lower section, said upstanding walls having aligned openings therein extending through the free edges of the respective walls to define an entrance into said storm cellar, pairs of upper and lower laterally spaced walls, each pair being cast integrally with the respective upper and lower sections and bracketing the respective openings, said pairs of walls extending outwardly away from the upstanding walls of said sections, the lower pair of walls having upper edges terminating in the horizontal plane of the upstanding wall of the lower section, the upper pair of walls having lower edges terminating in the horizontal plane of the upstanding wall of the upper section, and having upper edges terminating substantially in the plane of the horizontal wall of the upper section, lower steps of a portion of a stairway cast integrally between the lower pair of walls, the lower steps extending progressively from the lower end of said entrance to the upper edges of said lower pair of walls, upper steps of a portion of said stairway cast integrally between the upper pair of walls, said upper steps extending progressively from the lower to the upper edges of said upper pair of walls and being complementary with said lower steps, the upper and lower edges of the respective pairs of walls and the upper and lower ends of the respective lower and upper steps engaging each other to define a complete stairway extending from the upper edges of the upper pair of walls to the lower end of said entrance, the upper edges of the upper pair of walls defining with the upper end of said upper steps and that portion of the horizontal wall of the upper section between said upper pair of walls a substantially horizontal hatchway over at least a part of said stairway, and a displaceable hatch of a size for closing said substantially horizontal opening.

2. The storm cellar or the like of claim 1 wherein the walls of said sections include reinforcing bars.

3. The storm cellar or the like of claim 1 wherein the horizontal wall of the upper section includes ventilating means extending therethrough.

4. The storm cellar or the like of claim 1 including sealing material interposed between the engaging edges of the respective sections.

5. The storm cellar or the like of claim 1 wherein each section constitutes a unitary casting of reinforced concrete.

6. The storm cellar or the like of claim 1 wherein the said sections are portable.

7. The storm cellar or the like of claim 1 wherein each upstanding wall in cross section defines a rectangle.

8. The storm cellar or the like of claim 1 wherein said hatchway lies substantially in the same horizontal plane as the upper face of the horizontal wall of said upper section.

9. The storm cellar or the like of claim 8 wherein said cellar is adapted in use to be substantially completely buried in a complementary excavation.

10. The storm cellar or the like of claim 1 wherein when the free edge of the upstanding wall of the upper section is seated on the free edge of the upstanding wall of the lower section there is no additional connection apart from said seated edges between said sections.

* * * * *